US012698605B2

(12) United States Patent
Impero

(10) Patent No.: US 12,698,605 B2
(45) Date of Patent: Aug. 4, 2026

(54) MODULAR ROAD SAFETY BARRIER AND AN EMERGENCY OPENABLE PASSAGE

(71) Applicant: Pasquale Impero, Acerra (IT)

(72) Inventor: Pasquale Impero, Acerra (IT)

(73) Assignee: SMA ROAD SAFETY S.R.L., Naples (IT)

( * ) Notice: Subject to any disclaimer, the term of this patent is extended or adjusted under 35 U.S.C. 154(b) by 737 days.

(21) Appl. No.: 17/927,122

(22) PCT Filed: May 28, 2021

(86) PCT No.: PCT/IB2021/054695

§ 371 (c)(1),
(2) Date: Nov. 22, 2022

(87) PCT Pub. No.: WO2021/240459

PCT Pub. Date: Dec. 2, 2021

(65) Prior Publication Data

US 2023/0203767 A1 Jun. 29, 2023

(30) Foreign Application Priority Data

May 29, 2020 (IT) ..... 102020000012871

(51) Int. Cl.

| | |
|---|---|
| ***E01F 15/08*** | (2006.01) |
| ***E01F 13/04*** | (2006.01) |
| ***E01F 15/12*** | (2006.01) |

(52) U.S. Cl.
CPC ..... *E01F 13/048* (2013.01); *E01F 15/088* (2013.01); *E01F 15/12* (2013.01)

(58) Field of Classification Search
CPC ..... E01F 13/048; E01F 15/088; E01F 15/043; E01F 15/12
See application file for complete search history.

(56) References Cited

U.S. PATENT DOCUMENTS 5,156,485 A * 10/1992 Ivey ..... E01F 15/088 404/6
6,474,904 B1 * 11/2002 Duckett ..... E01F 15/086 404/6

(Continued)

FOREIGN PATENT DOCUMENTS

DE 10139891 C1 * 12/2002 ..... E01F 15/025
EP 0452893 A1 10/1991

(Continued)

*Primary Examiner* — Abigail A Risic
(74) *Attorney, Agent, or Firm* — Jacob M. Ward; Ward Law Office LLC

(57) ABSTRACT

A central road safety barrier includes modules mutually couplable by means of a bolt which engages holes made in protrusions extending in a longitudinal direction at the ends of the modules. Walls adjacent to the protrusions improve the transfer between the modules of an impact of an errant vehicle on the barrier and improve response to an impact. The safety barrier provides an emergency openable passage. A module may include a wall solidly constrained to an upright and adjacent to the protrusions of the module on a first side of the barrier. An openable passage module has a further wall solidly constrained to a further upright and adjacent to the protrusions of the openable passage module on a second side of the barrier.

19 Claims, 16 Drawing Sheets

(56) References Cited

U.S. PATENT DOCUMENTS

| | | | | |
|---|---|---|---|---|
| 7,654,768 | B1 * | 2/2010 | Tullis | E01F 15/083 404/6 |
| 10,544,555 | B1 * | 1/2020 | Lim | E01F 15/08 |
| 2020/0308786 | A1 * | 10/2020 | Hood | E01F 13/02 |
| 2023/0313474 | A1 * | 10/2023 | Impero | E01F 15/043 256/13.1 |
| 2025/0163660 | A1 * | 5/2025 | Johansson | E01F 15/088 |
| 2025/0179746 | A1 * | 6/2025 | Elmore | E01F 15/088 |

FOREIGN PATENT DOCUMENTS

| | | | | |
|---|---|---|---|---|
| EP | 0452893 | B1 * | 6/1994 | E01F 15/088 |
| GB | 2439081 | A * | 12/2007 | E01F 15/04 |
| KR | 100837684 | B1 * | 6/2008 | |

* cited by examiner

MODULAR ROAD SAFETY BARRIER AND AN EMERGENCY OPENABLE PASSAGE

FIELD OF THE INVENTION

The present invention relates to the technical sector relating to road safety systems used as passive containing elements for redirecting errant vehicles, in this way preventing the vehicles from invading the opposite carriageway or even exiting the carriageway.

DESCRIPTION OF THE PRIOR ART

In particular, the present invention concerns a modular road safety barrier, i.e. comprising modules that can advantageously be coupled with one another to form the barrier. The invention also relates to a passage or transition which can be used as an emergency openable passage.

Road safety systems for errant vehicles comprise safety barriers, terminals, transitions, openable passages and shock absorbers, as described in the EN 1317-1:2010 standard. The road safety barrier of the invention is preferably central, or a central reservation, i.e. installed between two carriageways.

The road safety barriers, in the following simply termed "barriers", are located by the side of the carriageway and extend longitudinally to contain an errant vehicle along a portion of road. Examples are illustrated in European patent application EP 2584096 A1 and in international application WO 2009090681 A1. The barriers comprise a series of uprights fixed in the ground, for example fixed to pins or lodged in the ground at a certain distance from one another, and beams or corrugated tapes which are fixed to the uprights in a longitudinal direction in such a way as to be consecutive to one another. The beams are fixed to the adjacent beams so as to form a continuous front to contain and redirect errant vehicles.

The beams are usually made of a metal material, such as for example aluminium or galvanized steel, and are designed so as to absorb, by deforming, an eventual impact caused by an errant vehicle that strikes against a guardrail. The beams are usually obtained by appropriately profiling pieces of metal sheet.

The installation of a like barrier type requires many operations at the place of installation with the consequent drawbacks in operational management and working times.

Another type of barrier commonly used is constituted by consecutively-arranged blocks; when the blocks are made of concrete this barrier is often known as the "New Jersey". In general, although numerous variants of blocks have been developed, the positioning and/or displacement of this type of barrier is simpler, while often requiring special tools.

Though New Jersey barriers have no significant discontinuities, nor protruding parts, and are characterised by a low capacity of absorbance of the impact of an errant vehicle. Therefore, the risks of damage and injury for persons are very high.

There is therefore a perceived need for a barrier that is easy to install and repair along the whole longitudinal extension thereof and which at the same time guarantees good absorbance of impacts while limiting discontinuity as much as possible.

Further, the sector perceives the need to have barriers available that enable a good approximation to the direction of the carriageway, including along the curves in the road.

Further, this need is still more keenly perceived when the barriers are placed at the central part of dual-carriageway roads, such as for example highways and motorways, it is not advisable for them to have interruptions as the containment of the errant vehicles is removed on a passage that is always open and, further, the longitudinal ends of the barriers terminating on the constantly-open passage need to be protected.

The openable passages are generally located at the central part of dual-carriageway roads and can be opened to allow passage from one carriageway to the other. Emergency openable passages have already been developed, which are a special category of the openable passages; for example, the emergency openable passages are used in the event of incidents that prevent the vehicular traffic on one of the two carriageways.

In general a central barrier therefore comprises openable passages at prefixed distances from one another. The barrier comprises interrupted fixed portions and, at the position of the interruptions, an openable passage is positioned which when in the closed condition restores the continuity of the barrier; in fact the openable passage is in general connected by terminals to the fixed portions.

The standards include the openable passages having to be opened in less than 30 minutes, while the emergency openings must be opened in 5 minutes.

In general the emergency openable passages have smaller openings, in the order of a few metres; typically an openable passage is 36 metres long, while an emergency passage is between 4 metres and 6 metres long.

European Patent EP 1247905 B1 describes an openable passage which comprises longitudinal elements arranged symmetrically on a first side and on a second side of the barrier to contain an errant vehicle on both carriageways. Each longitudinal element is connected to a respective longitudinal element, symmetrical with respect to a longitudinal vertical plane, by blocks which bear a vertical hinge for accommodating a pin that constrains the adjacent longitudinal elements to one another. The openable passage comprises terminals which enable connection thereof to the fixed part of the barrier. The terminals are normally connected to fixed parts by bolting; in the case that the fixed part is not adequate the terminals can be connected to a post. The EP 1247905 B1 solution enables moving parts of openable passage by extracting one or more pins but has discontinuities in connection with the fixed parts of barrier; further the solution has a limited cooperation between the openable passage and the fixed part of barrier in the absorbance of the impact. Similar drawbacks are found in the solution of European Patent Application EP 2107164 A2, which shows an openable passage which is connected to a fixed part of barrier by a joint that rotates with respect to a pin.

The present invention intends to obviate some of the drawbacks of the prior-art solutions.

SUMMARY OF THE INVENTION

A first aim of the present invention is to provide a module of a barrier which enables a simple and rapid installation of a barrier, as well as an eventual return to effective state.

A second aim of the invention is to improve the continuity of the barrier and the behaviour thereof with regard to impacts, in particular increasing the cooperation between the parts of adjacent barrier in absorbing the energy transferred following the impact of the vehicle and limiting, including during the impact, projections or discontinuities among the parts of the adjacent barriers.

An aim of some embodiments is to provide an installation of the modules in an angled position with respect to one another so as to follow the road direction.

An aim of some embodiments of the invention is to provide a passage which responds to the drawbacks of the prior art and is easily and rapidly openable, so as to be usable as an emergency openable passage.

A second aim of these embodiments of the invention is to improve the behaviour with regard to impacts of the barrier to which the openable passage is applied, especially in the transition zones between the openable passage and the part of barrier fixed to the ground. This is done in particular by increasing the cooperation between the parts of adjacent barrier in absorbing the energy transferred following the impact of the vehicle and by limiting, including during the impact, projections or discontinuities among the parts of the adjacent barriers.

A further aim of some embodiments is to realise a modular barrier the modules of which can be manufactured and installed rapidly in loco.

These and other aims, which will be obvious to the expert in the sector from a reading of the following text, are attained by means of a module of a road safety barrier for contacting and redirecting an errant vehicle according to claim 1 as well as a road safety barrier for contacting and redirecting an errant vehicle according to claim 8.

In accordance with the teachings of the present document, the coupling between modules of a road safety barrier occurs due to protrusions which extend longitudinally and comprise holes configured to accommodate a bolt suited to couple a module of the barrier with a further module that is successive or adjacent.

The module advantageously comprises a wall which is solidly constrained to the upright facing towards the further module and is adjacent to the protrusions on a first side of the road safety barrier, and preferably is joined thereto. The further module comprises a wall that is solidly constrained to the upright towards the module and is adjacent to the protrusions on a second side of the road safety barrier, and is preferably joined thereto.

The modules are appropriately configured and installed so that the wall of the module is adjacent to or touches the protrusions of the other module and vice versa.

In this way the protrusions and walls cooperate with the bolt in the transfer of the impact of the vehicle among the adjacent modules, limiting the tensions on the bolt and determining a better and more homogeneous response.

The teachings can be applied both to realise identical modules that form a barrier, and modules having a first longitudinal end that is different to the second longitudinal end.

The teachings are advantageously applicable also in the manufacturing of an openable passage, such as for example an emergency openable passage. In this case the passage module is preferably not fixed to the ground.

BRIEF DESCRIPTION OF THE DRAWINGS

Specific embodiments of the invention will be described in the following part of the present description, according to what is set down in the claims and with the aid of the accompanying tables of drawings, in which:

DESCRIPTION OF THE PREFERRED EMBODIMENTS

Figure 1:
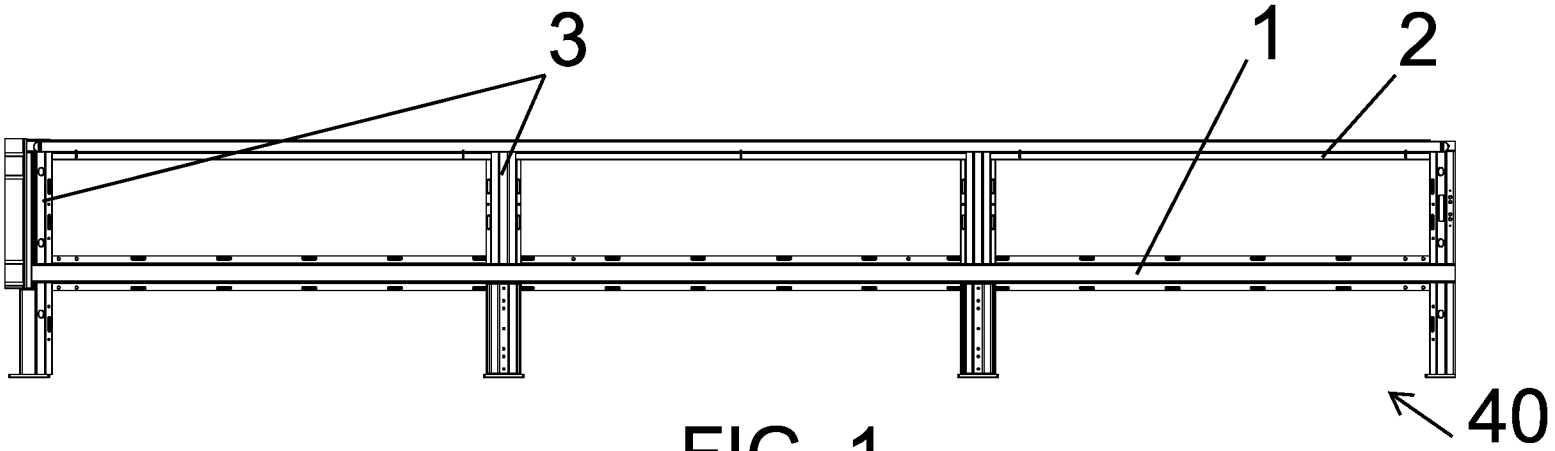
FIG. 1 is a lateral view of an embodiment of a first module of the invention.
Figure 2:
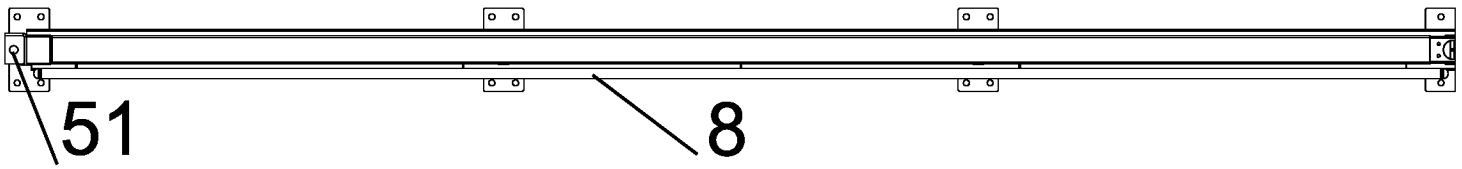
FIG. 2 is a view from above of FIG. 1.

With reference to the appended tables of drawings, reference numeral 100 denotes a road safety barrier for contacting and redirecting an errant vehicle on both a first side and a second side of the road safety barrier opposite one another.

In an embodiment the module (30, 60) of the road safety barrier (100) for contacting and redirecting an errant vehicle on both a first side and a second side of the module (30, 60) opposite one another comprises a first beam (1) which is arranged according to a longitudinal direction (X), a second beam (2) which is arranged according to a longitudinal direction (X), protrusions (5) and uprights (3), among which an upright (321) and a further upright (311).

As will be more fully detailed in the following the first beam (1) and the second beam (2) are preferably both internally hollow and the first beam (1) preferably comprises profiled members that are symmetrical with respect to a longitudinal vertical plane. Further, the first beam (1) is preferably joined to the uprights (3) by means of welds or brazing, as are the profiled members with one another.

The upright (321) and the further upright (311) support the first beam (1) and the second beam (2), at respective opposite longitudinal ends of the module (30, 60). Intermediate uprights (33) are preferably included, as will be clarified in the following.

The module (30, 60) herein described is intended to be repeated along the barrier (100) and therefore comprises protrusions (5) at both the longitudinal ends of the module. Each protrusion (5) extends in a longitudinal direction (X) and comprises a hole (51). The protrusions (5) and the holes (51) are configured so as to house a bolt (4) which couples another module (30, 40, 50, 60) in a coupling condition.

The module (30, 60) advantageously comprises a wall (64) which is solidly constrained to the upright (321) and which is adjacent, on a second side of the module (30, 60), opposite the first side, to the protrusions (5).

The module (30, 60) advantageously comprises a further wall (63) which is solidly constrained to the further upright (311) and which is adjacent, on a first side of the module (30, 60), to the protrusions (5).

Each protrusion (5) at the longitudinal end of the further upright (311) extends transversally towards the second side in such a way that the edge thereof facing towards the second side is substantially aligned to the inner face of the wall (64).

Each protrusion (5) at the longitudinal end of the further upright (321) extends transversally towards the first side in such a way that the edge thereof facing towards the first side is substantially aligned to the inner face of the further wall (63).

These characteristics can be observed in the views from above. In other words when the module (30, 60) is repeated identically, or substantially identically at the longitudinal ends, along the barrier (100), the coupling that will be explained in the following in terms of a barrier (100) will be realised with an appropriate configuration of the module (30, 60) between the longitudinal ends thereof.

That is, the protrusions (5) are configured to be located adjacently or in contact with the further wall (63) or the wall (64) of the module (30, 60) adjacent or successive to the barrier (100), with the wall (64, 63) to which they are positioned adjacent on the opposite side with respect to the wall (63, 64) to which they are always adjacent or, indeed, joined.

In the interest of greater precision, it could be said that each of the protrusions (5) extends transversally to cover the same distance from a halfway longitudinal vertical plane of the inner face of the wall on the opposite longitudinal end.

In the case of a flat inner face and lateral edge of the flat protrusion (5) it can be stated that the lateral edge and the inner face lie on the vertical plane.

In other words the protrusions (5) have horizontal and vertical flanks, the vertical flanks being configured to contact the wall (63, 64) of the adjacent module in the event of an impact, so as to transfer a part of the absorbed energy.

It must also be taken into account that the technical effects of the teachings associated hereto are also relevant should there be a slight distance between the protrusions (5) and the walls when the adjacent modules (30, 40, 50, 60) are coupled with one another by the bolt (4) or the further bolt (4). Consequently it is specified that the alignment does not have to be perfect but can take account of tolerances, especially useful during the installation step, which do not reflect negatively on the functioning.

The foregoing enables unloading on the adjacent module (30, 40, 50, 60) a part of the absorbed energy in the impact of an errant vehicle, without determining particular discontinuities or zones with high tensions.

Each of the protrusions (5) is preferably at least partially free, or is unobstructed, on its side opposite the side adjacent to the wall (64) or to the further wall (63).

The module (30, 60) preferably comprises a profiled member (68) either L-shaped or C-shaped which comprises the wall (64) and a further profiled member (67) either L-shaped or C-shaped which comprises the further wall (63).

Figure 31:
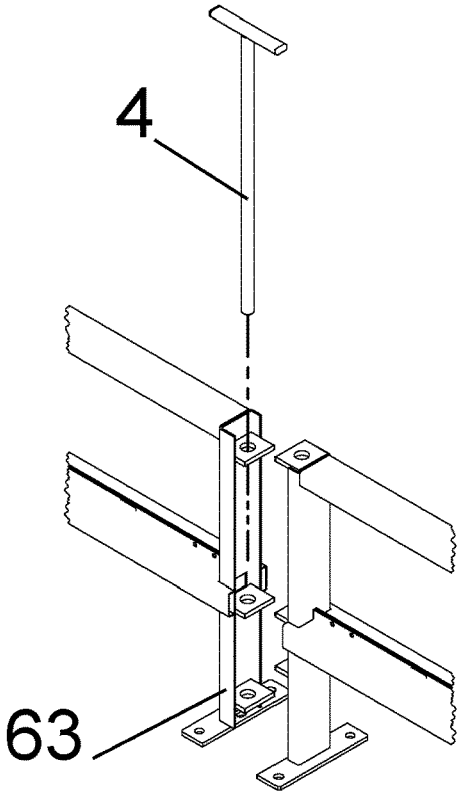
FIGS. 31, 32, 33 and 34 are embodiments of modules and barriers according to the invention.

As clearly shown in the various embodiments of the accompanying drawings, the uprights (3) can be joined or be solidly constrained to the further profiled member (67) and the profiled member (68), as can the L or C-shaped profiled members in general, or can comprise them. For example the first option is visible in FIG. 23 while the second option is visible in FIG. 31.

The C-shaped solution, being the asymmetrical C-shaped solution, is preferable with respect to the simple L-shaped solution as in the case of the C-shaped conformation the upright can be welded onto the foot on both sides, very preferably with the flaps parallel to the road side.

The further profiled member (67) and the profiled member (68) are preferably both C-shaped with the end of the C on the first side extending longitudinally for a greater portion with respect to the end of the C on the second side or vice versa.

In this way the installation of a successive module (30, 40, 50, 60) can take place by moving the module (30, 40, 50, 60) from the side, i.e. without having to retract it subsequently. This considerably facilitates the installing.

This is preferably not valid in general for a passage module (30); the further profiled member (67) and the profiled member (68) are both solidly constrained to a respective foot which is configured to be fixed to the ground and which has a first part and a second part which have different shapes from one another respectively on the first side and the second side of the barrier (100) and wherein the feet are configured in such a way as to be complementary to one another.

The feet are preferably plates or slab-shaped elements.

The feet preferably have an L-shaped base.

FIGS. 28 and 29 and FIGS. 33 and 34 clarify this concept. In the accompanying figures each of the feet is L-shaped and the horizontal portions of the L are respectively on a first side and on a second side of the barrier (100) so as to be complementary to one another in a longitudinal direction. In general, once the modules (30, 40, 50, 60) are coupled the feet form a quadrilateral and, very preferably, are symmetrical to one another with respect to a diagonal.

In general it is preferable for the feet to be asymmetrical if the upright (3) is an L-shaped or C-shaped profiled member and is asymmetrical; otherwise a part of the profiled member would exit from the respective foot and could not, for example, be welded along the perimeter thereof.

The further profiled member (67) and the profiled member (68) are preferably both solidly constrained in a permanent way to the first beam (1) and the second beam (2) by welds or brazing.

As can be observed in figures from 27 to 29 and from 33 to 34, the appropriate profiling or conformation of the feet facilitates the angling between adjacent or successive modules (30, 40, 50, 60). This is an advantage that derives primarily from the introduction of a coupling with a bolt (4) and holes (51) that form hinges so as to be able to rotate a module (30, 40, 50, 60) with respect to the adjacent module (30, 40, 50, 60). In general these are small angles, i.e. smaller than 5 sexagesimal degrees, often less than 2 sexagesimal degrees. This enables an easier installation of the barrier, especially in the presence of carriageways with curves.

Figures 24, 25, 26:
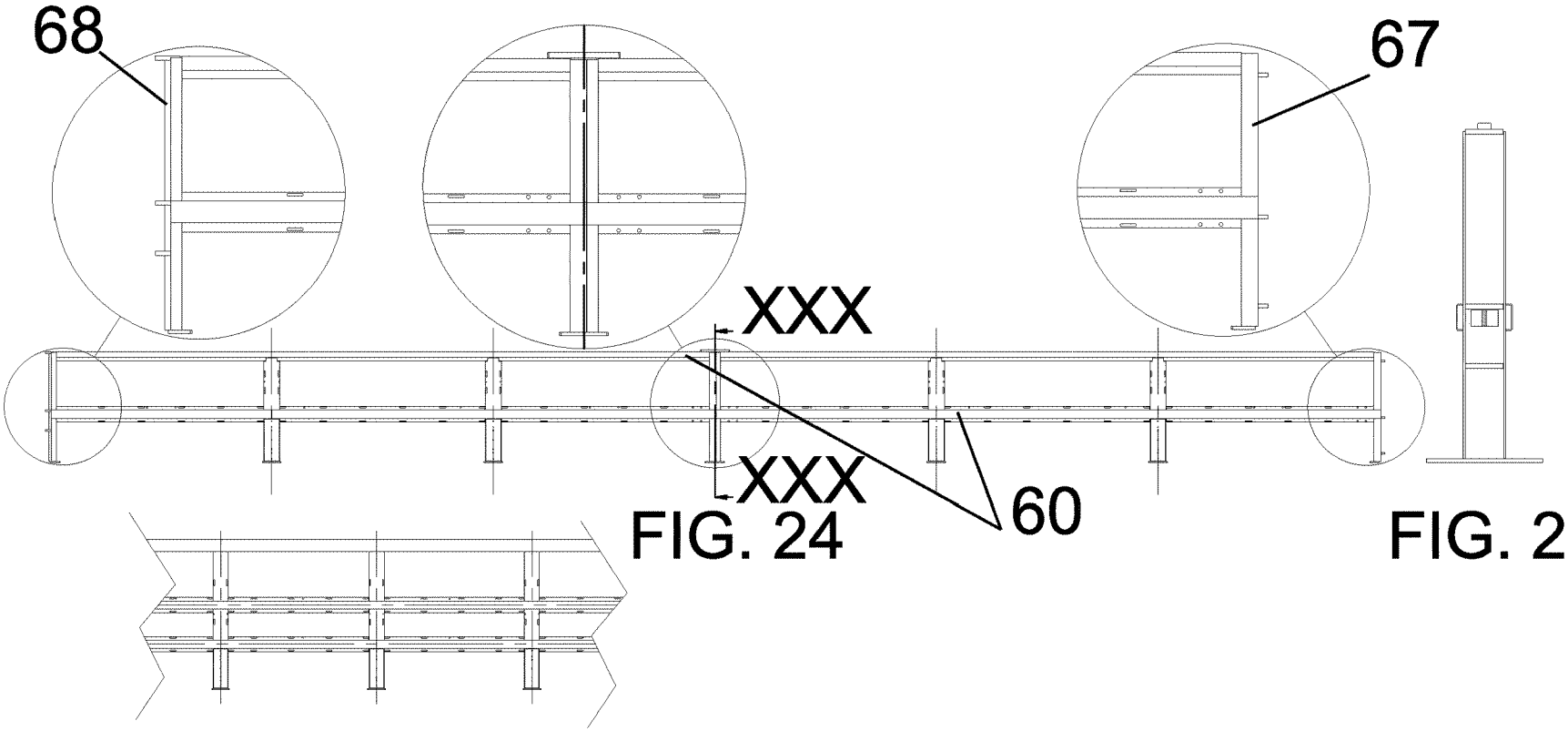
FIG. 24 is a lateral view of an embodiment of a barrier of the invention, and is represented in the outline of the cutting plane of FIG. 30.
FIG. 25 is a view from the left of FIG. 24.
FIG. 26 is a lateral view of a detail of a possible variant of the module with respect to the module of FIG. 24.
Figure 27:
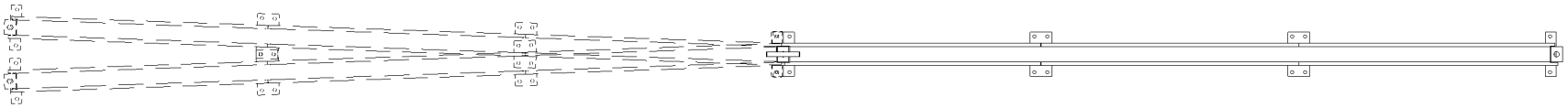
FIG. 27 shows possible relative angles between a module and a second further module according to the invention.
Figure 29:
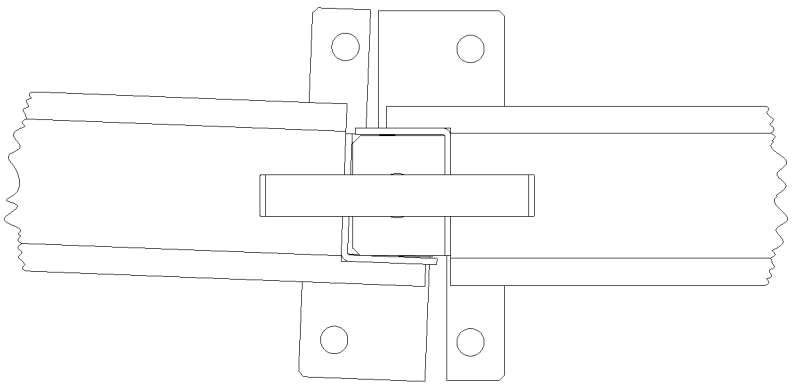
FIG. 28 and FIG. 29 relate to detail views from above of possible angles assumed between two adjacent or successive modules of an embodiment of a barrier of the invention.
Figure 28:
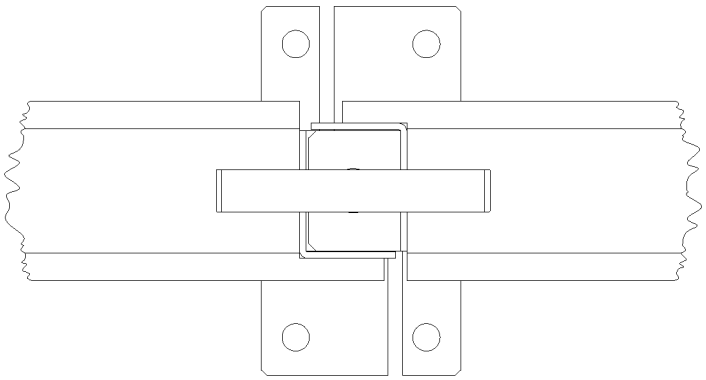
Figure 30:
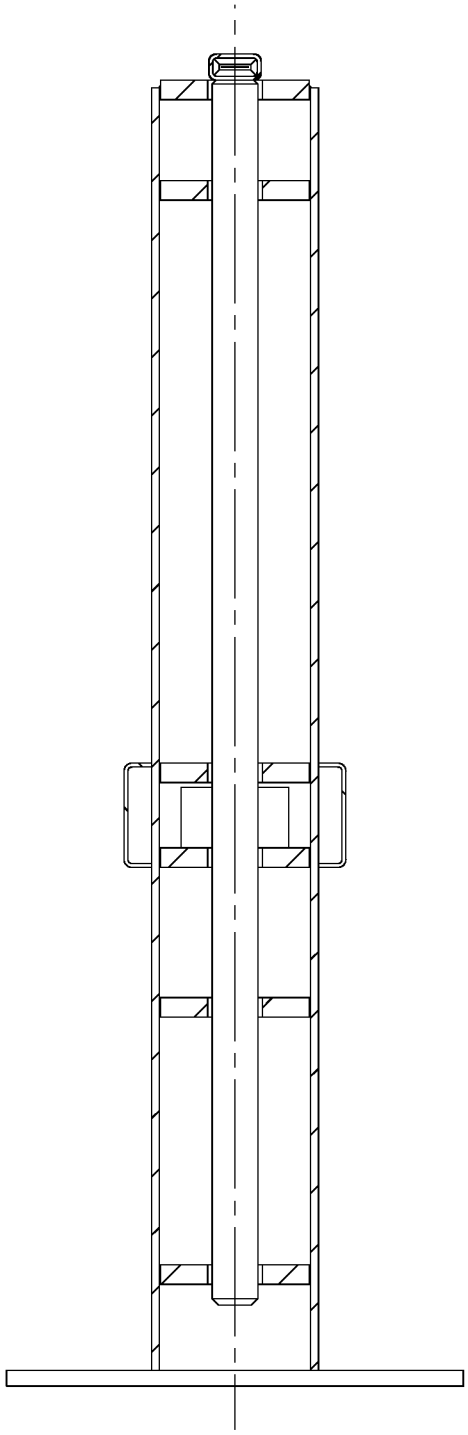
FIG. 30 is a section view of FIG. 24.

FIG. 26 clarifies that the teachings included herein can be extended directly to modules (30, 40, 50, 60) with further beams or further intermediate uprights (33) with respect to those represented in the accompanying tables of drawings. For example, with a first beam (1) and with a second beam (2) it is generally possible to realise a barrier in category H2 while with a further beam a barrier in category H4 might be realised.

The invention also relates to a road safety barrier (100) for contacting and redirecting an errant vehicle on both a first side and a second side of the barrier (100) opposite one another.

An embodiment of the barrier (100) comprises modules (30, 40, 50, 60) and at least a bolt (4).

The modules (30, 40, 50, 60) each comprise a first beam (1), a second beam (2) and uprights (3) which support the first beam (1) and the second beam (2).

The modules (30, 40, 50, 60) are generally configured so that the first beams (1) and the second beams (2) are at the same heights from the ground once fixed to the ground.

The bolt (4) is configured to connect, in a coupling condition, an upright (31, 321) which is located at a longitudinal end of a module (40, 60) and which is configured to be fixed to the ground and a further upright (311) which is located at a longitudinal end of a further module (30, 60). This can be either configured to be fixed to the ground or not.

Both the module (40, 60) and the further module (30, 60), at a respective longitudinal end, comprise protrusions (5), each extending in a longitudinal direction (X) and comprising a hole (51); the protrusions (5) and the holes (51) are configured so as to house the bolt (4) in the coupling condition.

Obviously the protrusions (5) of the module have opposite directions with respect to the protrusions (5) of the further module which face it.

The module (40, 60) advantageously comprises a wall (61, 64) which is solidly constrained to the upright (31, 321) and which is adjacent to the protrusions (5) of the module (40, 60) on a first side of the barrier (100).

Further, the further module (30, 60) comprises a further wall (63) which is solidly constrained to the further upright (311) and which is adjacent to the protrusions (5) of the further module (30, 60) on a second side of the barrier (100).

The module (40, 60) and the further module (30, 60) are configured in such a way that in the coupling condition the wall (61, 64) is adjacent to the protrusions (5) of the further module (30, 60) and the further wall (63) is adjacent to the protrusions (5) of the module (40, 60) in order to offload onto the adjacent module a part of the energy absorbed in the impact of an errant vehicle.

Figures 9, 10:
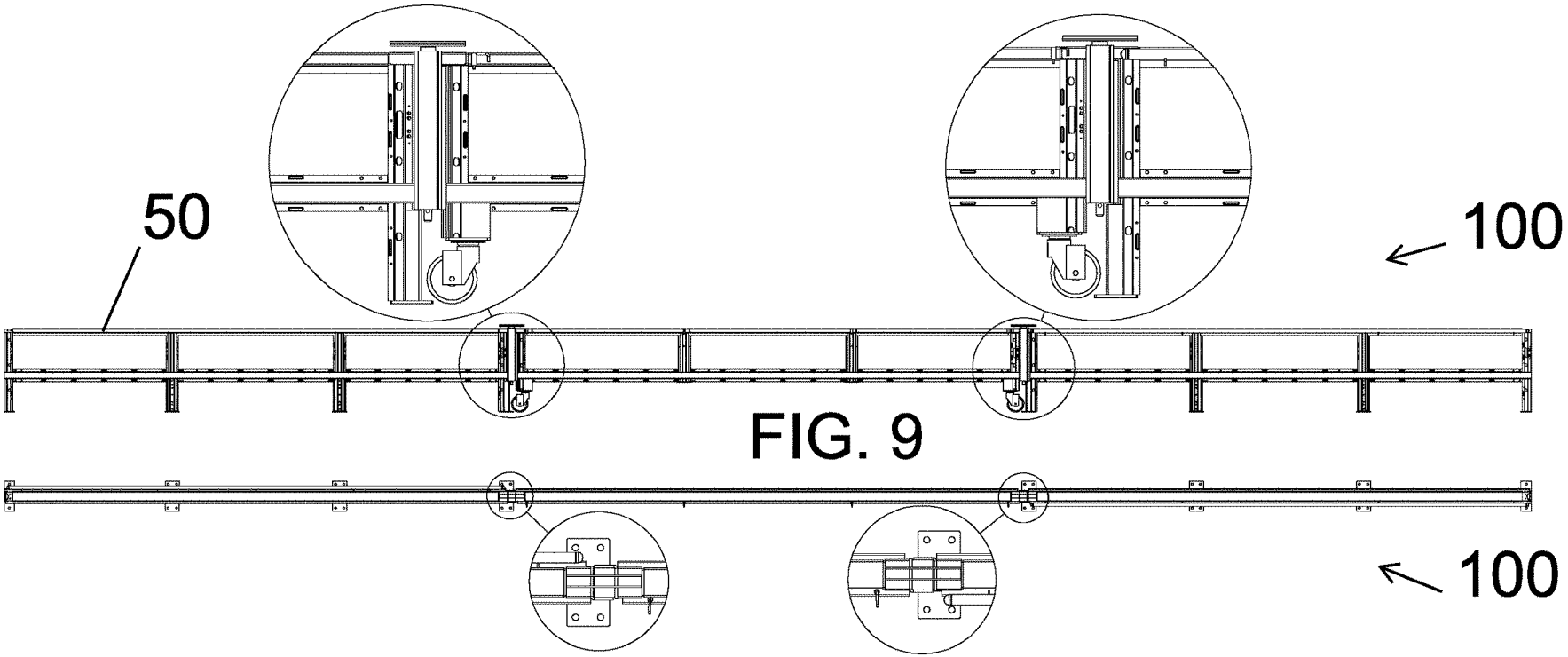
FIG. 9 is a lateral view of an embodiment of a module of a barrier according to the invention comprising a module, an openable passage module and a second further module in closed condition of the openable passage, complete with larger-scale details.
FIG. 10 is a view from above of FIG. 9; complete with larger-scale details.
Figure 16:
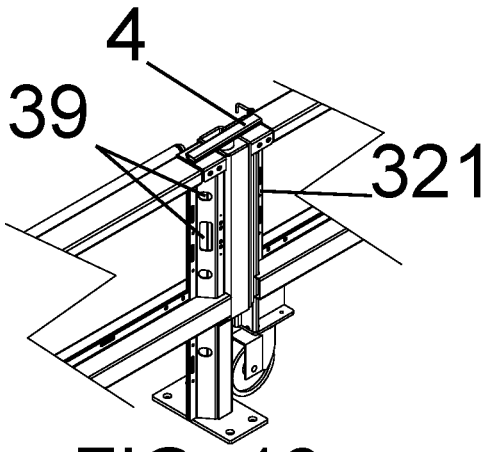
FIG. 16 and FIG. 17 illustrate larger-scale details of the first step of FIG. 15.

This configuration is represented, for example, in FIG. 9 or in FIG. 16.

Each of the protrusions (5) of the module (40, 60) is preferably configured to directly contact the further wall (63) in the case of an impact of an errant vehicle.

Likewise each of the protrusions of the further module (30, 60) is preferably configured to directly contact the wall (61, 64) in the event of an impact of an errant vehicle.

Figure 32:
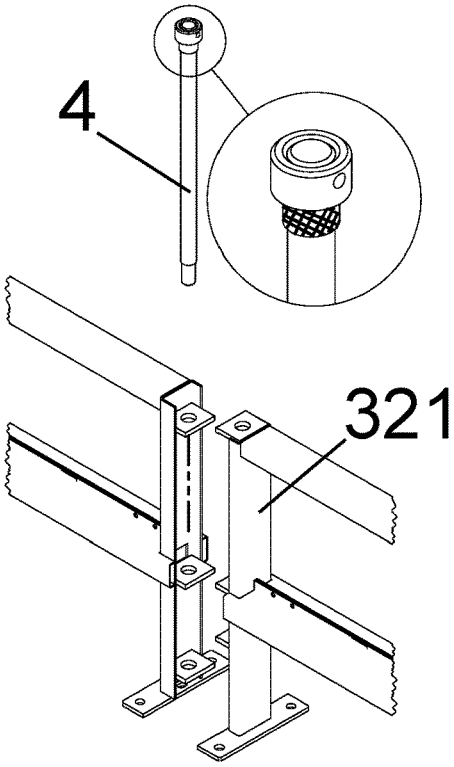
Figure 33:
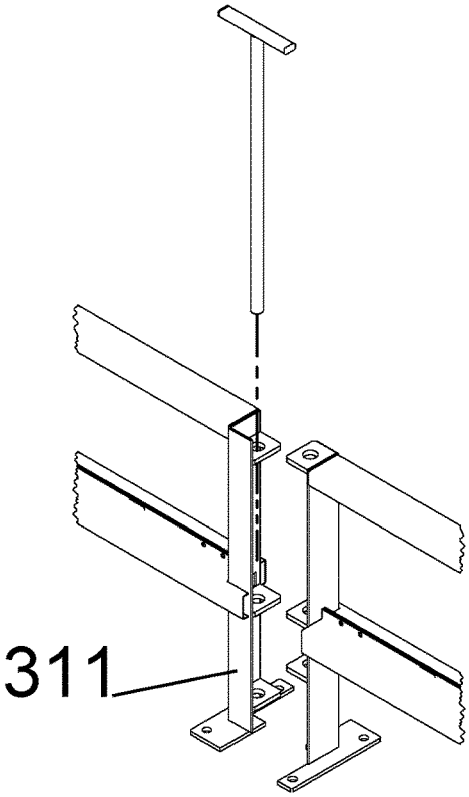
Figure 34:
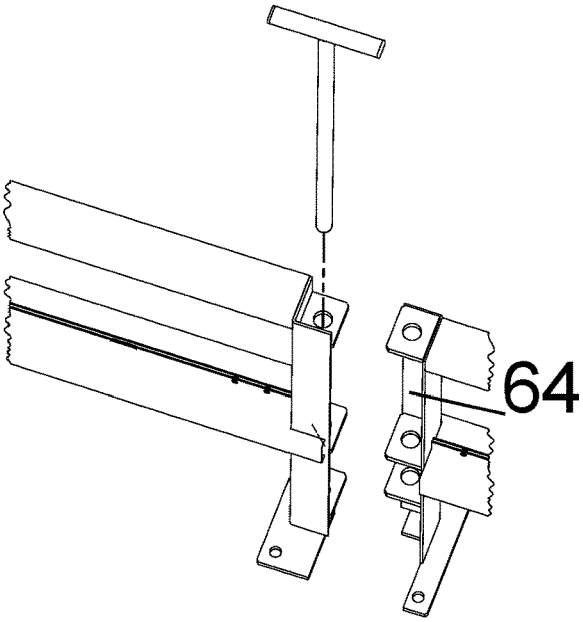

The bolt (4) is preferably threaded and the threading engages at least a threaded hole (51) of the protrusions (5). In the detail of FIG. 32 the threading is hatched. The threading is preferably realised on the bolt insertion side (4) into the holes (51), as this makes assembly simpler. In other words it is made so that the smooth part enters first (the bolt (4) is generally inserted from above in a downwards direction) into the holes (51), and after all of them are engaged, the top part is screwed in.

The threaded coupling further enables a locking among the parts which is not achieved with the smooth bolt (4). Clearly this solution can be applied to both the C-shaped members and the L-shaped members.

At least some of the protrusions (5) of both the upright (31, 321) and the further upright (311) are preferably arranged so as to be in proximity of the first beam (1) or the second beam (2). However, in figures from 31 to 34 it can be observed how the protrusions (5) are not present only at the first beam (1) and second beam (2) but can also be present at other distances from the ground to generate a more vertically continuous connection.

This configuration improves the longitudinal transfer of the impact.

The wall (61, 64) and the further wall (63) preferably both extend longitudinally at least over all the longitudinal extension of the respective protrusions (5).

The wall (61, 64) is preferably joined to the protrusions (5) of the module (40, 60) and the further wall (63) is joined to the protrusions (5) of the further module (30, 60).

The latter preferred embodiments improve the transfer of the tensions and limit point deformations, as will be further discussed in the following.

The module (40, 60) preferably comprises an L-shaped or C-shaped profiled member (65, 68) which comprises the wall (61, 64) and wherein the further module (30, 60) comprises an L-shaped or C-shaped further profiled member (67) which comprises the further wall (63).

The above is also valid in the case of the module (30, 60), especially relating to the asymmetry of the C-shape.

In the following another embodiment of the barrier is described, specially adapted to realise an openable passage, for example an emergency openable passage. The preferred technical solutions described in the following are also valid for the above-described solution, when the actuation thereof is compatible.

The modules (30, 40, 50, 60) each comprise a first beam (1), a second beam (2) and uprights (3) which support the first beam (1) and the second beam (2);

the modules are configured in such a way that the first beams (1) and the second beams (2) are substantially at the same heights from the ground.

Figure 11:
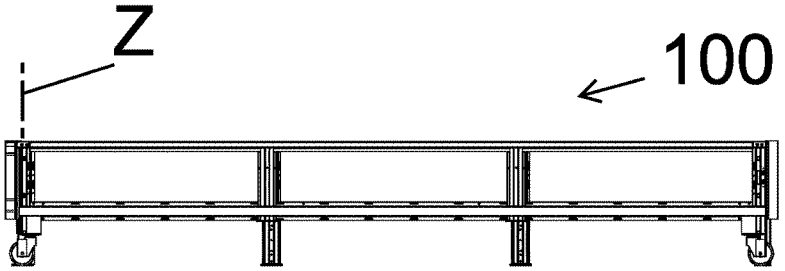
FIG. 11 illustrates a lateral view of the embodiment of the barrier of FIG. 9 in the open condition of the openable passage, in which the space between the first module and the second further module has been reduced in the illustration.
Figure 12:
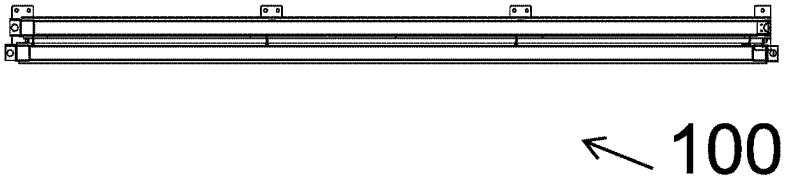
FIG. 12 is a view from above of FIG. 11.
Figure 13:
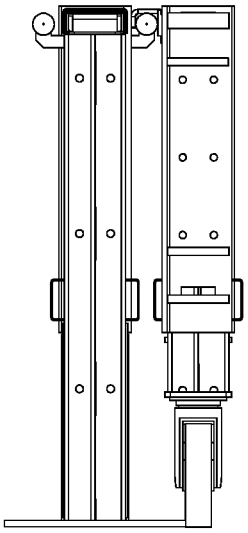
FIG. 13 is a view from the left of FIG. 11.
Figure 14:
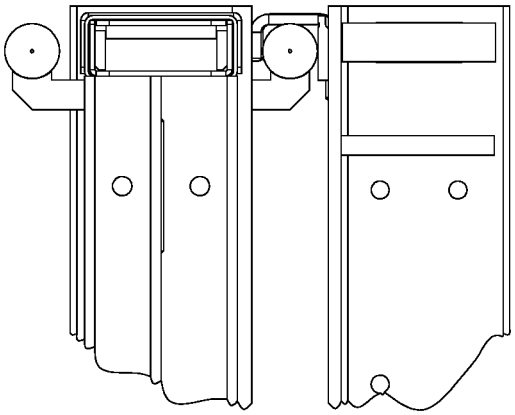
FIG. 14 shows a larger-scale detail of FIG. 13.

FIG. 11 shows a vertical extension direction (Z) of the uprights (3).

A module (40) comprises an upright (31) which is located at a longitudinal end and which is configured to be fixed to the ground; an openable passage module (30), in the following a passage module (30), comprises a further upright (311) which is located at the longitudinal end.

In a closed condition of the openable passage, in the following also referred-to as the closed condition of the passage, the bolt (4) connects the upright (31) and the further upright (311).

Both the module (40) and the passage module (30) comprise at least at one of the ends thereof, longitudinal protrusions (5), each extending in a longitudinal direction (X) and comprising a hole (51); the protrusions (5) and the holes (51) are configured so as to accommodate the bolt (4) in the closed condition of the passage.

Figure 23:
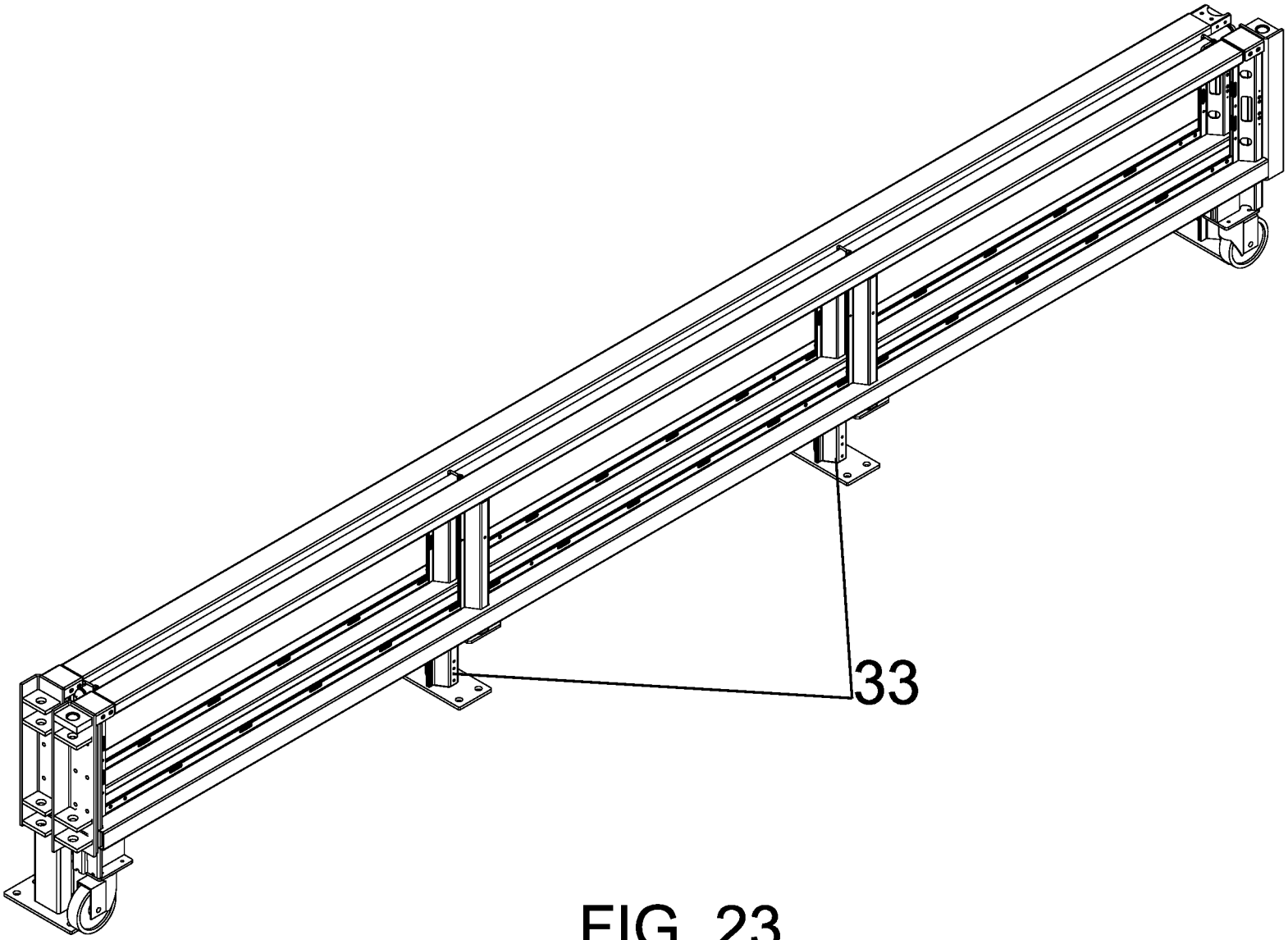
FIG. 23 illustrates the right modules of the fifth step of FIG. 15.

The module (40) advantageously comprises a wall (61) which is solidly constrained to the upright (31) and which is adjacent to the protrusions (5) of the module (40) on a first side of the barrier (100). FIG. 23 illustrates how the wall (61), as well as the other walls, are independent elements with respect to the beams.

Further, the further module (30) comprises a further wall (63) which is solidly constrained to the further upright (311) and which is adjacent to the protrusions (5) of the passage module (30) on a second side of the barrier (100).

Again, in the closed condition of the passage the wall (61) is adjacent to the protrusions (5) of the passage module (30) and the further wall (63) is adjacent to the protrusions (5) of the module (40) in order to offload onto the adjacent module a part of the energy absorbed in the impact of an errant vehicle. That is, the modules (30, 40, 50, 60) are configured so that this condition is realised.

The wall (61) and the further wall (63) advantageously cooperate with the bolt (4) to maintain the adjacent modules (30, 40, 50, 60) connected, thus reducing the tensions on the bolt (4).

As well as transferring a part of the energy absorbed by the module (30, 40, 50, 60) in the impact with an errant vehicle, the wall (61) and the further wall (63) limit the lateral detachment of a module (30, 40, 50, 60) with respect to the adjacent module (30, 40, 50, 60). The containing capability increases when the wall (61) and the further wall (63) both extend longitudinally at least over all the longitudinal extension of the respective protrusions (5).

Figure 3:
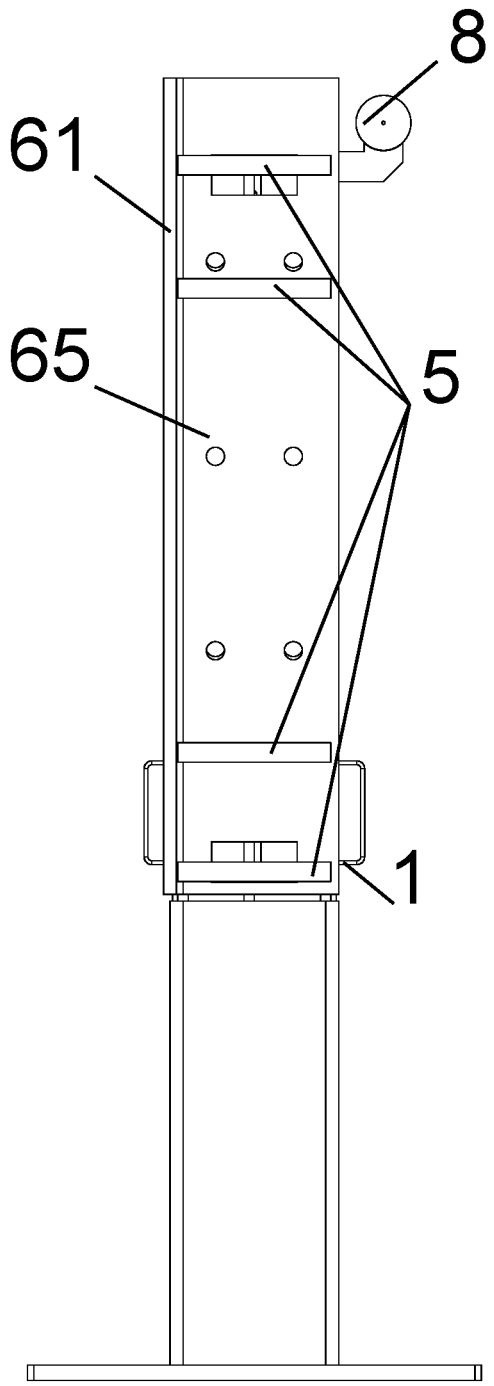
FIG. 3 is a view from the left of FIG. 1.
Figure 4:
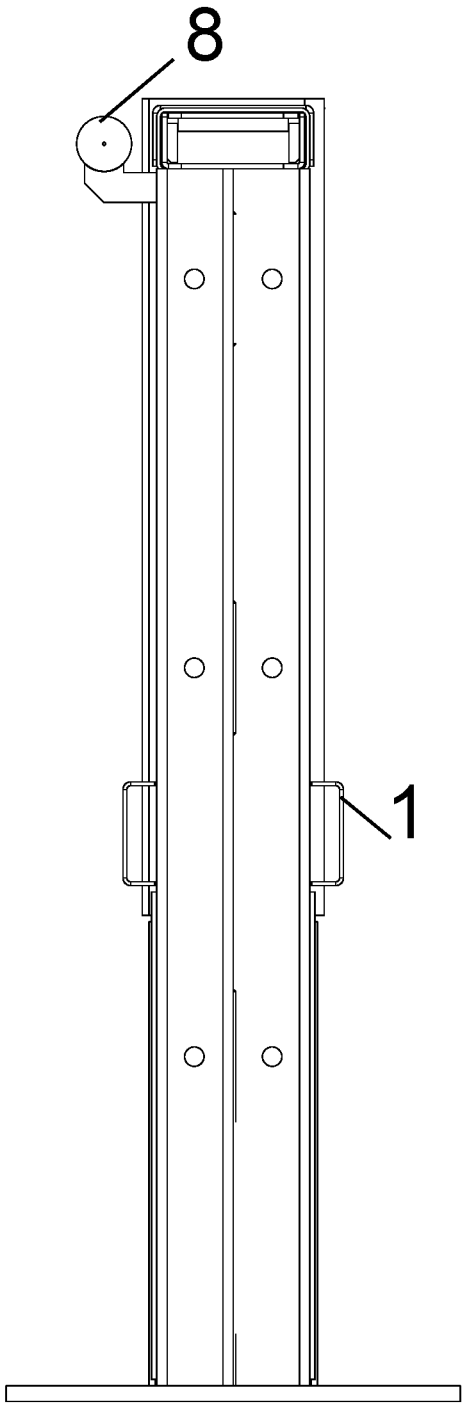
FIG. 4 is a view from the right of FIG. 1.
Figure 5:
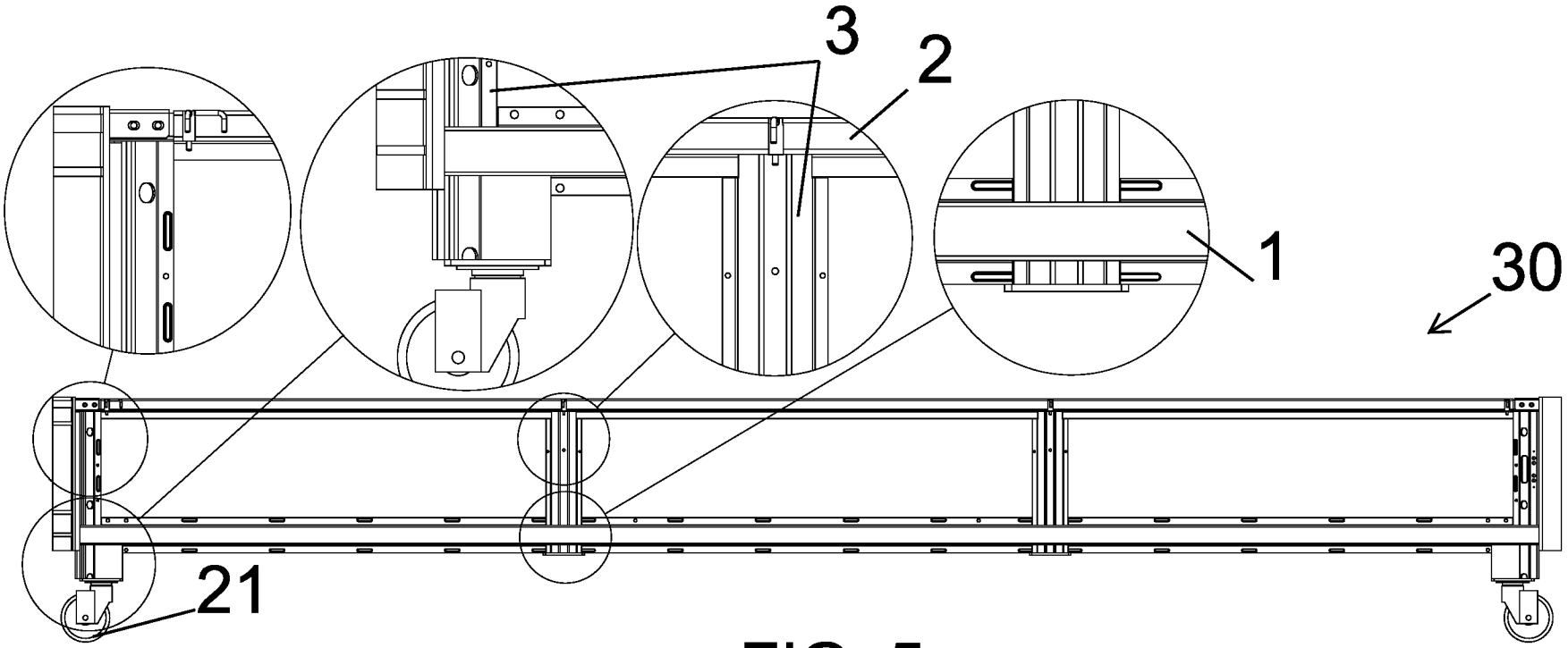
FIG. 5 is a lateral view of an embodiment of an openable passage module of the invention, complete with details in larger scale.
Figure 6:
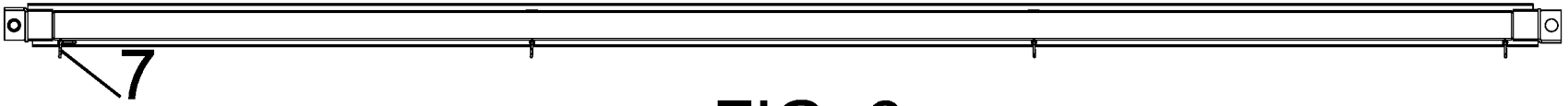
FIG. 6 is a view from above of FIG. 5.
Figure 7:
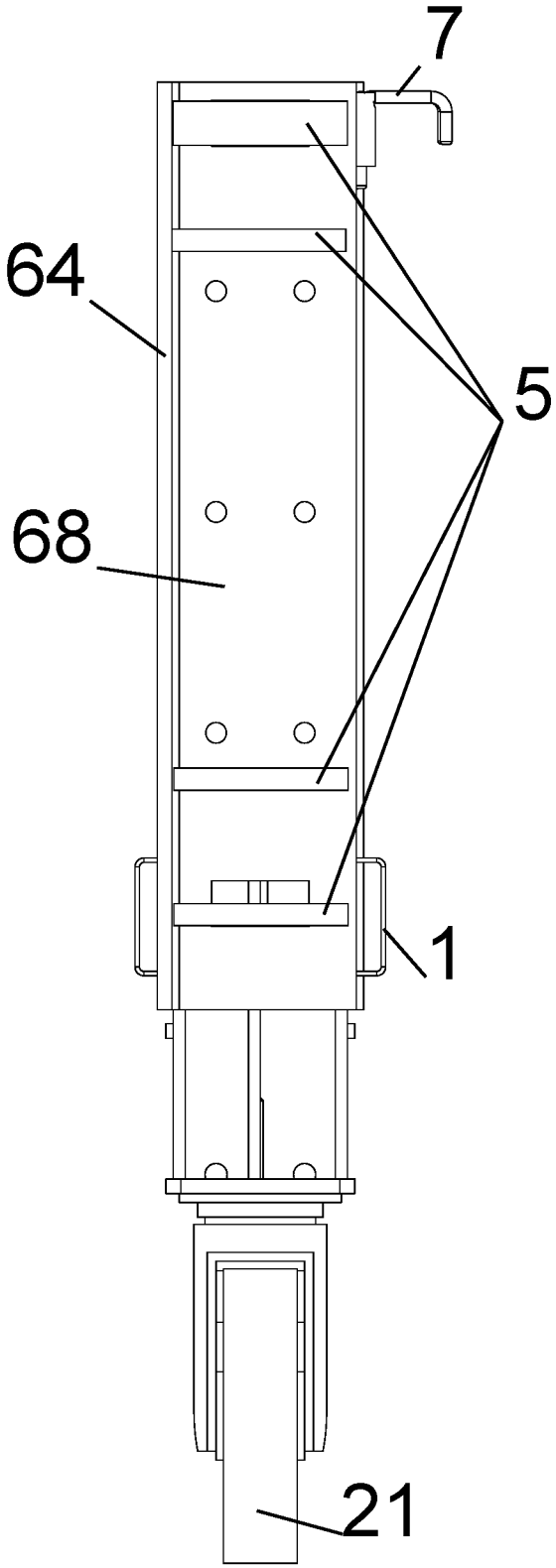
FIG. 7 is a view from the left of FIG. 5.
Figure 8:
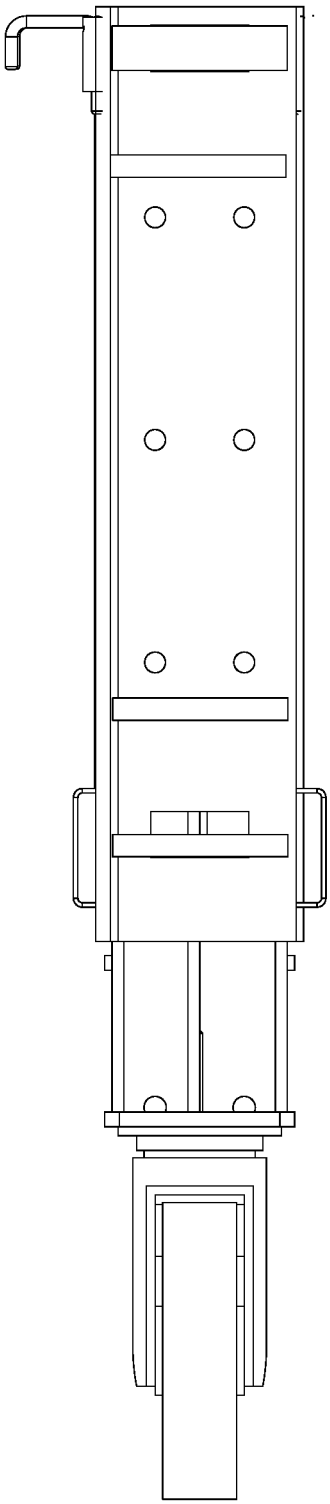
FIG. 8 is a view from the right of FIG. 5.

The protrusions (5) are preferably arranged to be in proximity of the first beam (1) or the second beam (2), also in the adjacent module (30, 40, 50, 60) in the closed condition of the passage, i.e. the vertical component of the distance between the protrusions (5) and the first beam (1) and the second beam (2) tends to reduce. This enables a more effective transmission of the longitudinal load in the event of an impact and can be observed in FIG. 3 and FIG. 7 relative respectively to the uprights (31, 321) or in FIG. 23. In both cases, as occurs also for the further uprights (32, 311), the protrusions (5) are located in proximity of the first beam (1) and the second beam (2).

Clearly, in relation to the foregoing description, the protrusions (5) of the uprights (3) configured to be adjacent are offset in relation to one another in a vertical direction (Z), so as to contact the wall (61, 62, 63, 64), which is flanked.

The protrusions (5) in proximity of the first beam (1) or the second beam (2) of each upright (3) are preferably at least two in number and very preferably a protrusion (5) of an upright (3) is interposed between the protrusions (5) of the upright (3) configured to be adjacent and vice versa.

Further, the benefits become more evident if the wall (61) is joined to the protrusions (5) of the module (40) and the further wall (63) is joined to the protrusions (5) of the passage module (30), preferably by welds (9).

The wall (61) and the further wall (63) preferably both extend longitudinally at least over all the longitudinal extension of the respective protrusions (5) and/or the wall (61) is joined to the protrusions (5) of the module (40) and the further wall (63) is joined to the protrusions (5) of the passage module (30).

The module (40) preferably comprises an L-shaped profiled member (65) which comprises the wall (61) and a wall joined to the upright (31) and the passage module (30) comprises a further L-shaped profiled member (67) which comprises the further wall (63) and a wall joined to the further upright (311).

The wall (61) and the further wall (63) are preferably welded to the respective uprights (3).

The L-shaped members are very preferably welded to the respective uprights (3) and the protrusions (5) extend from the L-shaped members.

In a practical embodiment the protrusions (5) are welded to the L-shaped members, for example the protrusions (5) can be holed plates welded at different heights.

Figure 22:
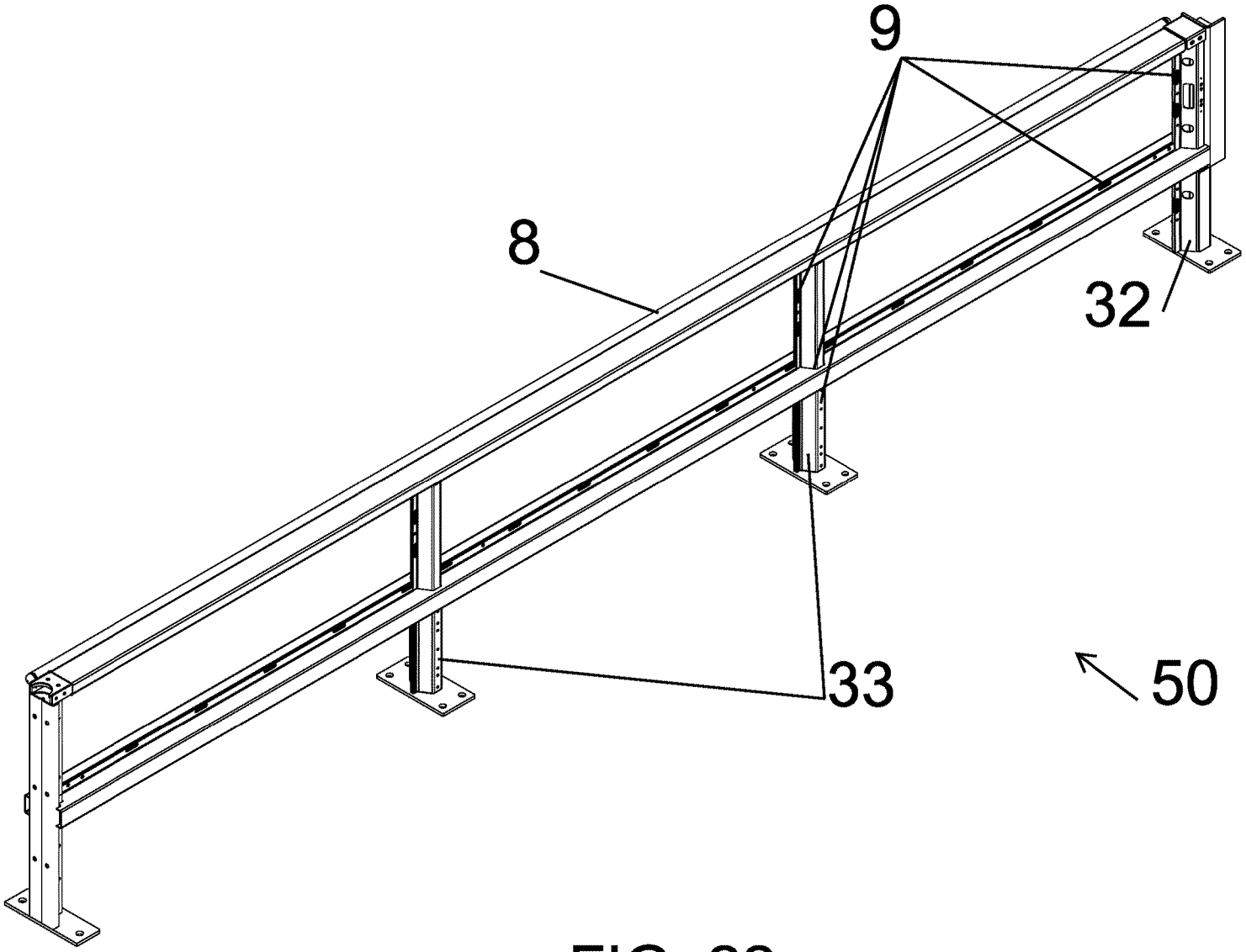
FIG. 22 illustrates the left module of the fifth step of FIG. 15.

FIG. 22 illustrates some welds (9) and enables an appreciation of the arrangement thereof, also together with the other accompanying tables of drawings. The welds enable joining or reciprocally constraining distinct elements to one another.

The L-shaped member makes the response to the impact of the errant vehicle and the transfer of the energy between the modules (30, 40, 50, 60) more homogeneous.

The joints are preferably realised by welds; the portions of weld improve the absorbance of energy, by reducing the maximum tensions on single portions.

In general, when possible, the passage module (30) is interposed between a module (40) and a second further module (50).

Therefore the barrier (100) preferably comprises a further bolt (4) and a second further module (50). The second further module (50) comprises a respective upright (32) which is located at a longitudinal end and which is configured to be fixed to the ground while the passage module (30) comprises an upright (321) which is located at the longitudinal end opposite the longitudinal end of the further upright (311).

In the closed condition of the passage, the bolt (4) connects the respective upright (32) and the upright (321).

The second further module (50) and the passage module (30) comprise further protrusions (5), each extending in a longitudinal direction (X) and comprising a hole (51), the further protrusions (5) and the holes (51) being configured so as to house the further bolt (4) in the closed condition of the passage.

The second further module (50) advantageously comprises a respective wall (62) which is solidly constrained to the respective upright (32) and which is adjacent to the protrusions (5) on a second side of the barrier (100), i.e. on the opposite side with respect to the wall (61).

Further, the passage module (30) comprises a wall (64) which is solidly constrained to the upright (321) and which is adjacent to the protrusions (5) on a first side of the barrier (100), i.e. on the opposite side with respect to the further wall (63).

Again, in the closed condition of the passage the respective wall (62) is adjacent to the further protrusions (5) of the passage module (30) and the wall (64) is adjacent to the further protrusions (5) of the second further module (50) in order to offload onto the adjacent module a part of the energy absorbed in the impact of an errant vehicle.

Figure 15:
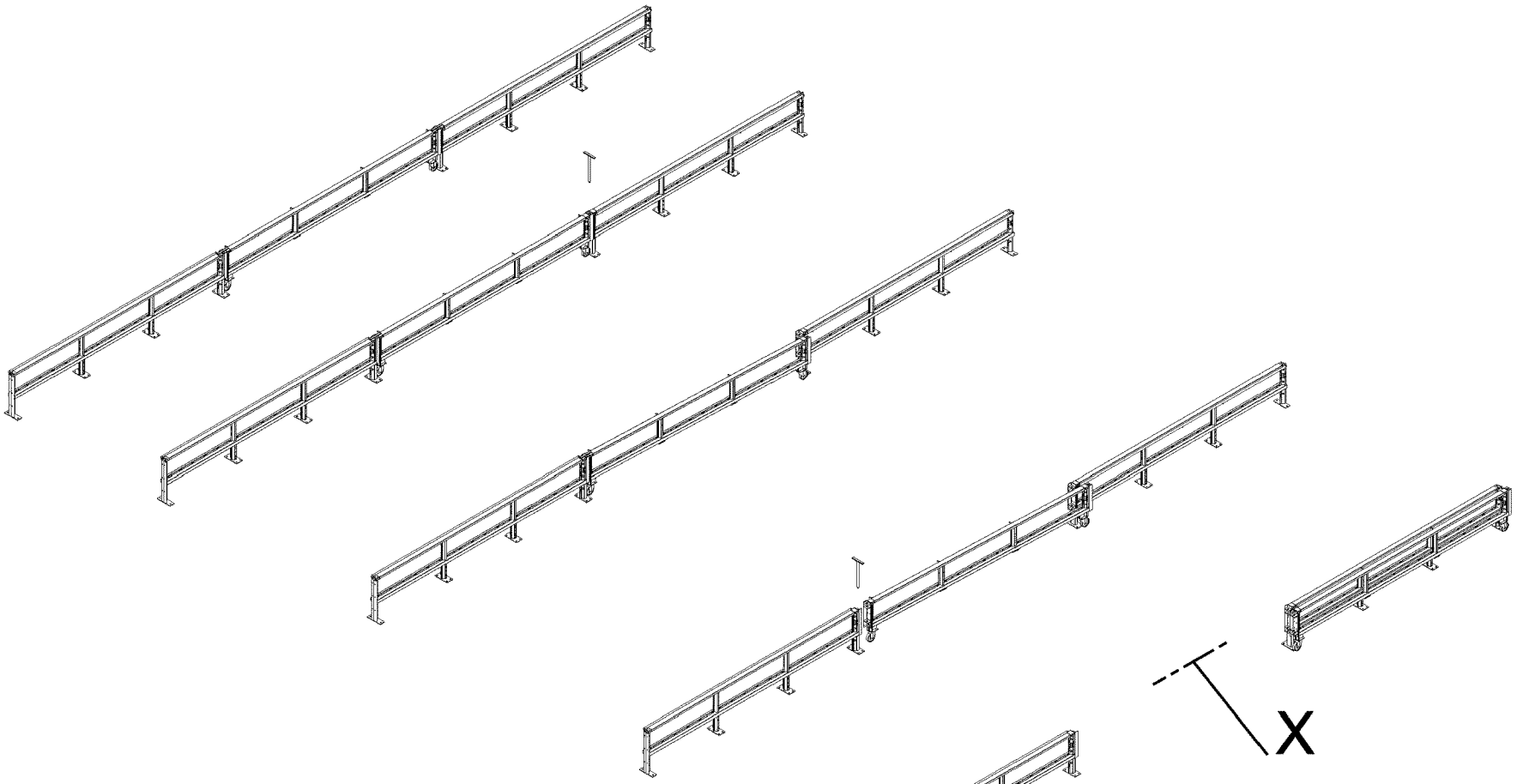
FIG. 15 is an opening sequence of the openable passage of an embodiment of the barrier.

The wall (61) and the respective wall (62) are advantageously on opposite sides of the barrier (100) so that the barrier (100) has identical behaviour on both sides. Further this facilitates the possibility of positioning the passage module (30) equally on the module (40) or on the second further module (50);

with reference to the third step of FIG. 15, the passage module (30) is displaced towards the observer but could equally have been displaced moving away, by acting on the opposite bolt (4), i.e. on the further bolt (4).

Although in a preferred embodiment the barrier (100) comprises a module (40) and a second further module (50) to be fixed to the ground among which the passage module (30), the second further module (50) is not strictly necessary. For example, in terminal zones of the barrier (100) the respective upright (32) might be an independent element, fixed to the ground or to another structure, such as for example a New Jersey.

In a case where the barrier (100) comprises a second further module (50), the connection between them and the passage module (30) is alike to what is described in the foregoing for the module (40), also taking the various options into account.

The respective wall (62) is preferably joined to the further protrusions (5) of the second further module (50) and the wall (64) is joined to the further protrusions (5) of the passage module (30).

The second further module (50) preferably comprises a respective L-shaped profiled member (66) which comprises the respective wall (62) and a wall joined to the upright (32) and wherein the passage module (30) comprises an L-shaped profiled member (68) which comprises the wall (64) and a wall joined to the upright (321).

In a preferred embodiment the passage module (30) comprises hooks (7) longitudinally spaced to engage the module (40) and/or the second further module (50) in an open condition of the openable passage. For this purpose the first module (40) and/or the second further module (50) can comprise suitable slots or a longitudinal guide (8) for accommodating the hooks (7).

The longitudinal guide (8) preferably has a round section to facilitate the sliding of the hooks (7).

Owing to the hooks (7), the passage module (30) is maintained stable in a vertical position with no need to have the support feet. The support feet reduce the safety of the barrier (100) if they are always present or complicate the opening operations if they must always be integrated during the opening.

Figure 17:
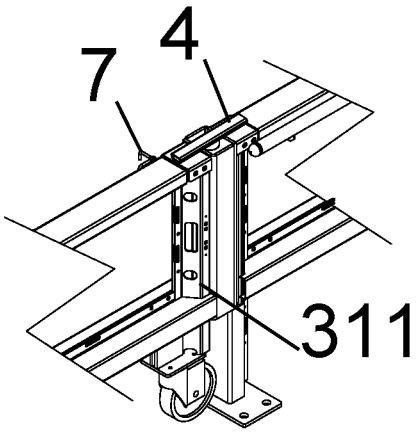
Figure 18:
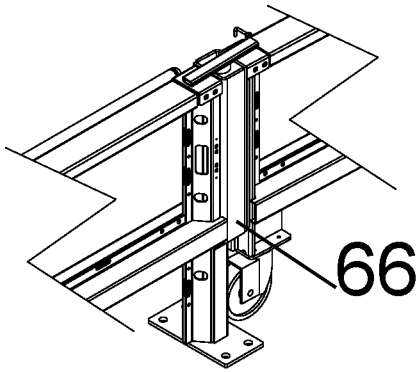
FIG. 18 and FIG. 19 illustrate larger-scale details of the third step of FIG. 15.
Figure 19:
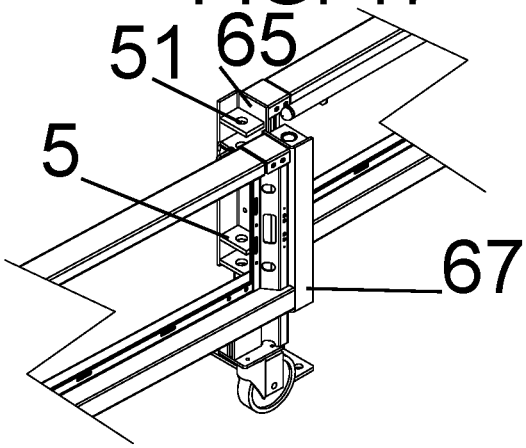
Figure 20:
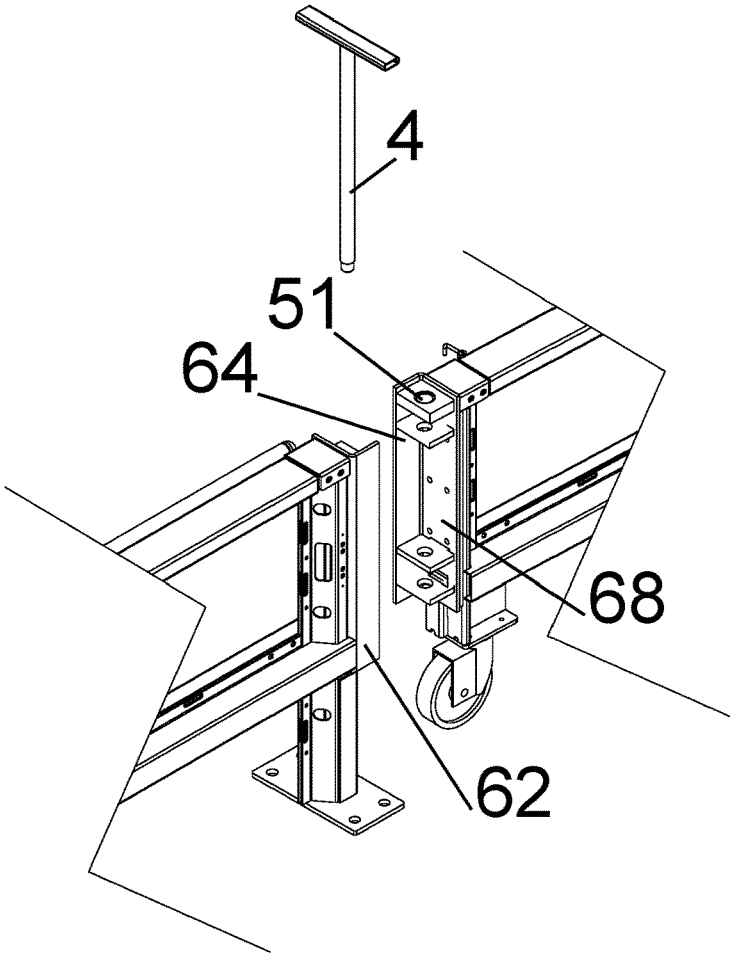
FIG. 20 and FIG. 21 illustrate larger-scale details of the fourth step of FIG. 15.
Figure 21:
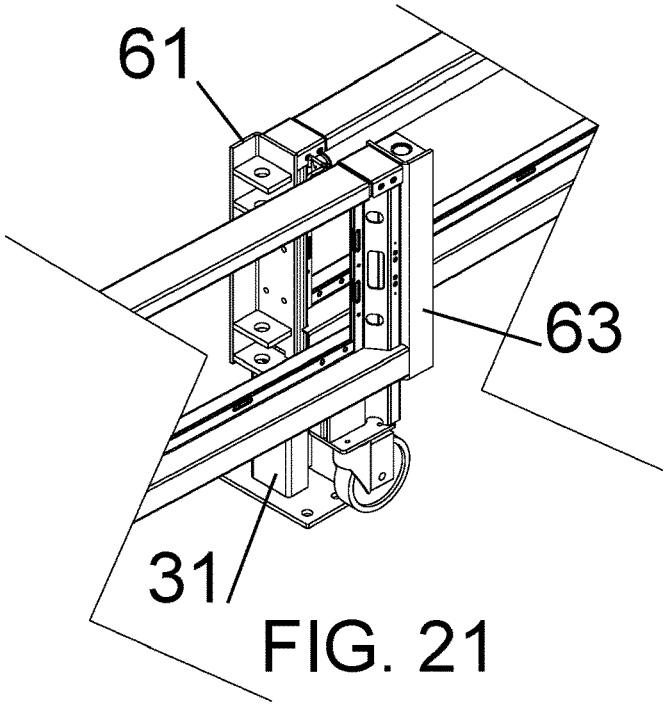

The hooks (7) are preferably movable between a rest position in which they are arranged in a longitudinal direction (X) and a working position in which they are arranged in a transversal direction. The mobility of the hooks (7) advantageously increases the safety of the barrier (100) in the closed condition of the passage, by preventing any impact or interaction with the vehicles or the people on the road. The two positions assumed by a hook (7) are observable, for example in FIGS. 17, 19 and 21.

In general the passage module (30) comprises wheels (21) which facilitate movement thereof. The wheels (21) are preferably connected to the further upright (311) and to the upright (321); in this way the passage module (30) is moved with ease after the bolt (4) or the further bolt (4) has been removed. In a preferred embodiment the further upright (311) and the upright (321) are configured to unload to the ground while those which would constitute the intermediate uprights (33), possibly present, will preferably be detached from the ground. Instead, in the module (40) and, possibly, in the second further module (50), the intermediate uprights (33) are preferably configured to be fixed to the ground. This difference between the passage module (30) and the module (40) is clearly visible in FIG. 23, in which it can be seen how the uprights (3), the first beam (1) and the second beam (2) of the passage module (30) substantially correspond to those of the module (40) with the exception of the absence of intermediate uprights (33), replaced with joining elements of the first beam (1) to the second beam (2).

Even if the passage module (30) comprises wheels (21), the module (40) preferably comprises a longitudinal guide (8) which is configured to slidably house the hooks (7).

The second further module longitudinal guide (50) preferably comprises a longitudinal guide (8) for housing the hooks (7), possibly configured to slidably house the hooks (7). In this way the operatives tasked with opening the passage can advantageously choose on which side of the barrier (100), first side or second side, to bring the passage module (30).

In the illustrated embodiments, the uprights (3) of the module (40) and the second further module (50) which uprights are longitudinally opposite respectively to the upright (31) and the further upright (32) are advantageously configured to contact like uprights (3) of further modules. The modules (30, 40, 50, 60) of the barrier (100) can thus be installed easily and rapidly in loco enabling the building of long portions with the intervalled presence of a module (40), an openable passage module (30) and a second further module (50) between identical modules which comprise longitudinally opposite uprights (3) with contact parts, alike to what is illustrated in FIG. 22.

The bolt (4) and/or the further bolt (4) preferably comprise a handle at the upper end for facilitating the extraction and insertion respectively during the opening and the closing of the passage. For example, in the embodiment of FIGS. 16 and 17, the handle is constituted by a beam joined by welding perpendicular to the body of the bolt (4) which engages the holes (51) of the protrusions (5).

In a further embodiment the bolt (4) is threaded, with the threading enmeshing in at least a seat made internally of the holes (51) of the protrusions (5). In this case the handle also facilitates the rotation of the threaded central body with respect to the nut screw.

The first beam (1) and the second beam (2) are preferably both hollow, i.e. internally hollow. The first beam (1) preferably comprises a first longitudinal part and a second longitudinal part which both project laterally with respect to the uprights (3), on opposite sides, and are joined so as to form a hollow beam and are both joined to the uprights (3). These joints are very preferably made using welds (9).

The first longitudinal part and the second longitudinal part are preferably symmetrical with respect to a vertical longitudinal plane passing through the centre line of the uprights.

The first longitudinal part and the second longitudinal part are preferably both a profiled member with a section in the shape of an omega (Ω) and are joined to one another at several points at both ends of the omega, preferably by welds. The first longitudinal part and the second longitudinal part more preferably form slits between successive weld points between the first longitudinal part and the second longitudinal part which are spaced from one another in a longitudinal direction.

The second beam (2) preferably comprises a central body which is constituted by a single part with an open section, i.e. having a slot facing towards the ground.

Each upright (3) is also preferably hollow and the first beam (1), the second beam (2) and each upright (3) comprise intermediate parts which are located between the ends of the respective cavities and which are in communication with the external environment via slots or holes (39) so as to discharge the liquid of a zinc galvanizing dip. In this way the module (30, 40, 50, 60) can be produced and subjected to treatments in its entirety before being installed.

In this way the surface corrosion protection process can correctly be carried out after the first beam (1) and the second beam (2) have been joined to the uprights (3), preferably by means of welds (9).

FIG. 22, or the detail illustrations preceding it, enable better observation of the slot interrupted by the weld (9) on the first beam and the slots interrupted by welds (9) on the uprights (3). The slots and the holes (39) are preferably a plurality for each element or extend for a considerable portion in a longitudinal direction or in a vertical direction. Further, at least the slots preferably extend according to a longitudinal direction or a vertical direction, i.e. not in a transversal direction, so as not to significantly reduce the resistance to impact of an errant vehicle.

The barrier is preferably conceived to obtain a high level of containment, for example of the H2 or H4 type; this means that the barrier preferably successfully passes an impact test with an automobile at 100 km/h and an impact test with a bus at 70 km/h and/or with a rigid lorry at 65 km/h with impact angles of 20 sexagesimal degrees and with respective masses of 900 kg, 13000 kg and at least 30000 kg.

The invention further relates to barriers which comprise further beams as the teachings apply likewise, for example, to barriers having greater containment levels; H2 barriers usually comprise a beam between the lower and upper ends of the uprights (3) while H4 barriers comprise two beams. The module (30, 40, 50, 60) of the present invention can be made in the factory with obvious advantages for the installation step and with the possibilities for automation.

It is understood that the above has been described by way of non-limiting example and that any constructional variants are considered to fall within the protective scope of the present technical solution, as claimed in the following.

The invention claimed is:

1. A module of road safety barrier for contacting and redirecting an errant vehicle on both a first side and a second side opposite one another, comprising:

a first longitudinal beam;

a second longitudinal beam;

an upright and a further upright that support the first beam and the second beam, at respective opposite longitudinal ends of the module;

protrusions at both longitudinal ends of the module, each extending in a longitudinal direction and comprising a hole, the protrusions and the holes being configured so as to house a bolt which couples another module, the module being characterised in that:

the module comprises a wall which is solidly constrained to the upright and which is adjacent, on a second side of the module, to the protrusions;

the module comprises a further wall which is solidly constrained to the further upright and which is adjacent, on a first side of the module, to the protrusions;

each protrusion at the longitudinal end of the further upright extends transversally towards the second side in such a way that the edge thereof facing towards the second side is substantially aligned to the inner face of the wall;

each protrusion at the longitudinal end of the upright extends transversally towards the first side in such a way that the edge thereof facing towards the first side is substantially aligned with the inner face of the further wall.

2. The module of claim 1 comprising a profiled member either L-shaped or C-shaped which comprises the wall and a further profiled member either L-shaped or C-shaped which comprises the further wall.

3. The module of claim 2 wherein the profiled member and the further profiled member are both L-shaped or the further profiled member and the profiled member are both C-shaped with the end of the C on the first side which extends longitudinally for a greater portion with respect to the end of the C on the second side or vice versa.

4. The module of claim 2 wherein the further profiled member and the profiled member are both solidly constrained to a respective foot which is configured to be fixed to the ground and which has a first part and a second part which have different shapes from one another respectively on the first side and the second side of the barrier and wherein the feet are configured in such a way as to be complementary to one another.

5. The module according to claim 4 wherein the respective foot has an L-shaped base.

6. The module of claim 2 wherein the further profiled member and the profiled member are both solidly constrained in a permanent way to the first beam and the second beam by welds or brazing.

7. The module according to claim 1 wherein each of the protrusions is at least partially unobstructed on its side opposite the side adjacent to the wall or to the further wall.

8. A road safety barrier for contacting and redirecting an errant vehicle on both a first side and a second side of the barrier opposite one another, and comprising:

modules which each comprise a first beam, a second beam and uprights which support the first beam and the second beam, the modules being configured in such a way that the first beams and the second beams are at the same heights from the ground;

a bolt configured to connect, in a coupling condition, an upright which is located at a longitudinal end of a module and which is configured to be fixed to the ground and a further upright which is located at a longitudinal end of a further module;

wherein both the module and the further module, at a respective longitudinal end, comprise protrusions, each extending in a longitudinal direction and comprising a hole, the protrusions and the holes being configured so as to house the bolt in the coupling condition, the barrier being characterised in that:

the module comprises a wall which is solidly constrained to the upright and which is adjacent to the protrusions of the module on a first side of the barrier;

the further module comprises a further wall which is solidly constrained to the further upright and which is adjacent to the protrusions of the further module on a second side of the barrier;

wherein the module and the further module are configured in such a way that in the coupling condition the wall is adjacent to the protrusions of the further module and the further wall is adjacent to the protrusions of the module in order to offload onto the adjacent module a part of the energy absorbed in the impact of an errant vehicle.

9. The barrier of claim 8 wherein the bolt is threaded and the threading engages at least a threaded hole of the protrusions.

10. The barrier of claim 8 wherein at least some of the protrusions of both the upright and the further upright are arranged so as to be in proximity of the first beam or the second beam.

11. The barrier according to claim 8 wherein the wall and the further wall both extend longitudinally at least over all the longitudinal extension of the respective protrusions.

12. The barrier of claim 8 wherein the wall is joined to the protrusions of the module and the further wall is joined to the protrusions of the further module.

13. The barrier according to claim 8 wherein the module comprises an L-shaped or C-shaped profiled member which comprises the wall and wherein the further module comprises an L-shaped or C-shaped further profiled member which comprises the further wall.

14. The barrier according to claim 13 wherein the profiled member and the further profiled member are L-shaped or asymmetrical C-shaped.

15. The barrier according to claim 8 wherein the further module is an openable passage module which comprises hooks longitudinally spaced to engage the module in an open condition of the openable passage.

16. The barrier of claim 15 wherein the hooks are movable between a rest position in which they are arranged in a longitudinal direction and a working position in which they are arranged in a transversal direction.

17. The barrier of claim 15 wherein the passage module comprises wheels and the module comprises a longitudinal guide which is configured to slidably house the hooks.

18. The barrier of claim 15 wherein:

the barrier comprises a further bolt for connecting, in a closed condition of the passage, a respective upright which is located at a longitudinal end of a second further module and which is configured to be fixed to the ground, and a second further upright which is located at the longitudinal end of the passage module opposite the longitudinal end of the upright;

the second further module and the passage module comprise, at a respective longitudinal end, further protrusions, each extending in a longitudinal direction and comprising a hole, the further protrusions and the holes being configured so as to house the bolt in the closed condition of the passage;

the second further module comprises a respective wall which is solidly constrained to the respective upright and which is adjacent to the protrusions on a second side of the barrier;

the passage module comprises a second further wall which is solidly constrained to the second further upright and which is adjacent to the protrusions on a first side of the barrier;

the passage module and the second further module are configured so that in the closed condition of the passage the respective wall is adjacent to the further protrusions of the passage module and the second further wall is adjacent to the further protrusions of the second further module in order to offload onto the adjacent module a part of the energy absorbed in the impact of an errant vehicle;

the respective wall is joined to the further protrusions of the second further module and the second further wall is joined to the further protrusions of the passage module.

19. The barrier according to claim 1 wherein each of the protrusions of the module is configured to directly contact the further wall in the case of an impact of an errant vehicle.

* * * * *